US009530608B2

(12) United States Patent
Hansen

(10) Patent No.: US 9,530,608 B2
(45) Date of Patent: Dec. 27, 2016

(54) X-RAY GENERATION FROM A SUPER-CRITICAL FIELD

(71) Applicant: X-Illumina, Inc., Dublin, CA (US)

(72) Inventor: Steven D. Hansen, Dublin, CA (US)

(73) Assignee: X-Illumina, Inc., Dublin, CA (US)

( * ) Notice: Subject to any disclaimer, the term of this patent is extended or adjusted under 35 U.S.C. 154(b) by 258 days.

(21) Appl. No.: 14/506,362

(22) Filed: Oct. 3, 2014

(65) Prior Publication Data

US 2015/0124935 A1 May 7, 2015

Related U.S. Application Data

(60) Provisional application No. 61/887,248, filed on Oct. 4, 2013.

(51) Int. Cl.

| | |
|---|---|
| ***H01J 35/08*** | (2006.01) |
| ***H01J 35/06*** | (2006.01) |
| ***H05G 2/00*** | (2006.01) |
| ***H05H 1/52*** | (2006.01) |

(52) U.S. Cl.

CPC ..... *H01J 35/08* (2013.01); *H01J 35/065* (2013.01); *H05G 2/00* (2013.01); *H05H 1/52* (2013.01)

(58) Field of Classification Search

CPC ..... H01J 35/08; H01J 35/065; H05G 2/00; H05H 1/52

USPC ..... 378/119–122

See application file for complete search history.

(56) References Cited

U.S. PATENT DOCUMENTS

| | | | | |
|---|---|---|---|---|
| 4,598,915 | A * | 7/1986 | Gilbert | F16L 5/10 277/606 |
| 5,031,199 | A * | 7/1991 | Cole, III et al. | G03F 7/70008 378/34 |
| 6,775,354 | B1 | 8/2004 | Roffers | |
| 2003/0142790 | A1 | 7/2003 | Zhou et al. | |
| 2011/0188635 | A1 | 8/2011 | Cho et al. | |
| 2013/0028386 | A1 | 1/2013 | Jeong et al. | |

FOREIGN PATENT DOCUMENTS

WO WO-2013/061051 A1 5/2013

OTHER PUBLICATIONS

International Search Report and Written Opinion in PCT/US2014/059151, dated Jan. 13, 2015.

* cited by examiner

*Primary Examiner* — Courtney Thomas
(74) *Attorney, Agent, or Firm* — McDermott Will & Emery LLP

(57) ABSTRACT

Described herein are methods and systems relating to an x-ray generation system. In some embodiments, the system includes an electron beam acceleration region that generates an electron beam and accelerates electrons in the beam and a radiation generation region that (i) receives the electron beam and (ii) generates an electric field having an energy of greater than about 10E7 V/m without electrical breakdown of vacuum gaps. The electric field is configured to decelerate electrons in the electron beam sufficiently to generate x-ray energy.

36 Claims, 6 Drawing Sheets

X-RAY GENERATION FROM A SUPER-CRITICAL FIELD

RELATED APPLICATIONS

This application claims priority benefit from U.S. Provisional Application No. 61/887,248, filed Oct. 4, 2013, the entire contents of which are incorporated herein by reference.

TECHNICAL FIELD

The field of this disclosure relates generally to the process of creating x-rays for use in medical, industrial, and research applications.

BACKGROUND

"X-Ray Sources" or "X-Ray Tubes" are the generating source of x-rays used in a wide variety of medical, industrial, and research devices, with many different sizes, configurations, and enclosures required by the large variety of machines that use them. However, all x-ray tubes operate by the same principle of bremsstrahlung, or braking radiation, as that of the very first sources of x-rays when x-rays were first discovered by W. C. Roentgen in 1895.

In these devices x-rays are produced through the interaction of high speed electrons with the atomic structure of a target material. In a typical x-ray tube configuration the electrons are emitted at the cathode though various means such as thermionic emission from a tungsten filament. Application of a potential difference between the cathode and the target, such that the target is electrically positive in regards to the cathode, shapes the electrons into a focused beam and accelerates the electrons to high velocities. Accelerating potentials of 150 kVp will result in electrons travelling at approximately two-thirds the speed of light. To avoid interaction with other gas atoms and molecules this process is performed in a high vacuum environment. When these energetic, high speed electrons strike the target material, which is part of an anode structure, they interact with the atoms of the target material. These interactions result in the deceleration of the high speed electrons and the release of energy. At best, only about 1% of the energy of the electrons is converted into x-radiation. The remaining energy transforms into heat energy. X-rays are generated in all directions and with a variety of energies ranging up to that of the accelerating electron. Only those x-rays traveling in the direction required for use exit the x-ray tube. The remaining x-rays are attenuated by the material of the x-ray tube housing.

Early x-ray tubes were derived from cathode ray tubes known as Crookes or Hittorf's tubes which were popular in the scientific community at the time of x-ray discovery in 1895. The Crookes cathode ray tube includes a sealed cylindrical glass tube, in which two electrodes are placed. One electrode, termed the cathode, was sealed in line with the main axis of the tube. One electrode termed the anode was placed off axis usually laterally in the cylindrical wall of the tube. When the tube was evacuated to a level of 0.01 mmHg and a sufficient electrical potential was applied between the electrodes, ionization of the residual gas in the x-ray tube would occur. The negative potential applied to the cathode caused positively charged gas ions to be accelerated to the cathode surface. These ions bombarded the surface of the cathode which caused the ejection of electrons. These electrons in turn were accelerated by the electric field down the axis of the tube and impacted the glass wall opposite the cathode thereby generating x-rays. The electrons eventually drained across the inside glass surface and to the anode electrode. Drawbacks of such devices included the rapid heating of the glass surface due to the poor efficiency of x-ray production.

These drawbacks led to the development of the ion x-ray tube in the first decade of the 20th century. An ion x-ray tube included a focusing cathode, one or two anode assemblies, and a means to regulate the internal vacuum level. The focusing cathode was metallic, usually aluminum, and had a concave, spherical shape that focused electrons onto a small area, called the focal spot, on the target mass. The anode was generally a thin refractory material such as tungsten or platinum brazed to a heavy mass of copper. The copper provided quick heat transfer away from the focal spot. Operation of the tube depended on the correct vacuum level. As a result of normal tube operation, the tube pressure would gradually be reduced, and methods for raising the pressure to support gas ionization in the tube were developed. These methods usually worked on the principle of diffusing gas through thin walled tubes of palladium or platinum. Methods to reduce the tube pressure, should it be too high, included intermittent operation of the tube with low tube currents.

Ion x-ray tubes were replaced with the introduction of the high vacuum, high voltage x-ray tubes, first introduced in 1913 by W. D. Coolidge. This included the basic design principles used by many modern high power x-ray tubes. The main advantages of the high vacuum, high voltage Coolidge tube include the elimination of gas ions, which cause erratic operation, and the independent control of the tube current and the applied potential. High vacuum x-ray tubes, or Coolidge tubes, operate on the principle of electron emission, such as that from a hot tungsten filament, located in the cathode assembly. As gas ionization is no longer required for the operation of the tube, a Coolidge tube typically operates in the range of 0.000001 mmHg or lower. To increase the quantity of x-rays generated, the filament is heated electrically, thereby increasing the emission of electrons which are then accelerated to the target. To increase the penetrating ability of the x-ray, the applied tube potential can be increased independent of the tube current.

Improvements in the thermal loading capability of the focal spot and therefore x-ray tube power were made in the Coolidge x-ray tube with the introduction of the line focus concept and rotation of the anode assembly. Gas ion tubes produce circular electron beams that, when impacting a target placed at 45 degrees to the normal of the electron beam, produce an x-ray focal spot of an apparent circular cross-section when viewed along the central ray of the tube, which is at right angles to the normal of the electron beam. To improve thermal loading and main image resolution, the high vacuum tube utilizes a filament coil to create an electron beam of rectangular cross-section. When this beam impacts a sloping target with a shallow target angle, the apparent focal spot size along the central ray will appear to be emitted from a much smaller area. An additional improvement was made with the introduction of a rotating anode assembly, to which the target material is attached. By spinning the target during an exposure, target loading is increased by the ratio of the focal spot width to the circumferential length of the target track thereby greatly increasing the power capability of the x-ray tube.

SUMMARY

Notwithstanding the history and development of x-ray tube design, making them bigger and more complex, the current basic principles of x-ray generation remains the same as the Coolidge x-ray tube. In such designs, the interaction of high energy electrons with matter (i.e., the target) produces x-radiation, and these systems are at best 1% efficient. With increased size and complexity comes increased cost of both the x-ray source and the associated equipment used to power the x-ray source, such as the x-ray generators, incoming power conditioners, anode rotation electronics, and mechanics and complex liquid cooling apparatus. A significant portion of medical diagnostic imaging equipment is related the initial cost of the x-ray generation apparatus and the long term cost of replacing failed devices. Embodiments of the present disclosure resolve many of the existing concerns and problems of x-ray generation.

This disclosure describes methods and systems of an x-ray tube whereby x-ray energy is created by the rapid deceleration of high energy electrons by a super-critical electric field rather than a physical target. This field, acting as a virtual target, decelerates the electrons uniformly, resulting in efficiencies much greater than the 1% of previous x-ray tubes and generates an x-ray beam of near uniform energy.

The methods and systems can be used in many different applications. For example, in medical applications, a system which diagnostically images or therapeutically treats through the use of x-rays would employ a device described by this disclosure for the generation of those x-rays. Examples of such diagnostic systems include those used in CT scanning, mammography, radiographic, and fluorographic imaging, densitometry and other such applications. Examples of use in therapeutic devices would include skin and near surface locations, therapy in superficial organs such as the eye, throat, nose, and other similar indications where x-ray technology is utilized.

In industrial applications a system, which identifies, determines, diagnoses, or modifies through the use of x-ray, would employ a device described by this disclosure for the generation of those x-rays. Examples of industrial systems include those used for elemental characterization of a material, locations of faults and flaws in a sample or assembly through x-ray imaging, irradiating items which derive benefit from x-ray dose, and other similar devices.

In research applications, a system which studies wide ranging uses such as the study of crystallographic structures, impact of x-rays on biological samples, and the use of x-rays in electronic processes are examples of areas where the methods and systems described herein could be employed.

Described herein are devices for generating x-ray energy, comprising: an electric field generator that generates an electric field having an energy of greater than about 10E7 V/m without electrical breakdown of vacuum gaps; and an electron beam generator that generates an electron beam and directs the beam toward the electric field.

In some embodiments, wherein the electric field generator generates the electric field without electrical breakdown of vacuum gaps by pulsing on and off before processes leading to vacuum breakdown can be established. The generator pulses on and off to generate the electric field for about 100 picoseconds to about 90 nanoseconds. In some embodiments, the generator pulses on and off to generate the electric field for about 10 nanoseconds to about 90 nanoseconds.

Some embodiments provide that the electric field is configured to decelerate electrons in the electron beam sufficiently to generate x-ray energy. The electron beam generator may generate the electron beam by thermionic emission. The electron beam generator may generate the electron beam by cold emission. The electron beam generator may generate the electron beam by enhanced work-function emission.

Some embodiments further include a cathode having a potential and an electron collector configured to be at or near the cathode potential, such that electrons not decelerated through the electric field are collected. Certain embodiments further include a decelerating ring electrode at which the electric field is generated. Some embodiments also include an x-ray tube frame and a power supply for the decelerating ring electrode is attached directly to the frame. Some embodiments include an x-ray tube frame, and a power supply for the decelerating ring electrode is positioned within the frame.

In some embodiments, the electron beam generator and the electric field generator are configured to produce various pulse forms and amplitudes to generate a desired x-ray spectrum. In some embodiments, the device is configured to have a variable vertical focal spot positioning and a variable focal spot shape. Some embodiments provide that the electric field generator is configured to reverse the electric field to first decelerate the electron beam, and thereafter, as the beam passes through a ring electrode, decelerate the beam through electrostatic attraction and bending the electron beam back.

Some embodiments herein describe an x-ray tube having an electron beam acceleration region that generates an electron beam and accelerates electrons in the beam; and a radiation generation region that (i) receives the electron beam and (ii) generates an electric field having an energy of greater than about 10E7 V/m without electrical breakdown of vacuum gaps; wherein the electric field is configured to decelerate electrons in the electron beam sufficiently to generate x-ray energy.

Some embodiments further include a cathode having a potential and an electron collector configured to be at or near the cathode potential, such that electrons not decelerated through the electric field are collected. The electron beam acceleration region may generate the electron beam by thermionic emission. The electron beam acceleration region may generate the electron beam by cold emission. The electron beam acceleration region may generate the electron beam by enhanced work-function emission.

In some embodiments, the electron beam is accelerated by the acceleration region across a vacuum gap. Some embodiments provide the electron beam acceleration region comprises a drift tube into which the electron beam is directed prior to the electron beam being received by the radiation generation region. In some embodiments, the tube includes an electrode for the application of a radiational decelerating field.

Some methods described herein for generating x-ray energy include generating, with an electric field generator, an electric field having an energy of greater than about 10E7 V/m without electrical breakdown of vacuum gaps; and directing an electron beam, from an electron beam generator, toward the electric field.

Some methods further include pulsing generation of the electric field on and off, such that processes leading to vacuum breakdown are not established while the electric field is generated. In some methods, the time the electric field is pulsed on is from about 100 picoseconds to about 90 nanoseconds. In some methods, the time the electric field is pulsed on is from about 10 nanoseconds to about 90 nanoseconds. In some methods, the electric field decelerates electrons in the electron beam sufficiently to generate x-ray energy.

In certain methods, the electron beam generator generates the electron beam by thermionic emission. The electron beam generator may generate the electron beam by cold emission. The electron beam generator may generate the electron beam by enhanced work-function emission. Some methods include collecting electrons not decelerated through the electric field with an electron collector configured to be at or near a potential of a cathode of the electron beam generator. In some methods, the electric field is generated at a decelerating annular electrode.

Some methods include varying at least one of the electron beam generator or the electric field generator to generate a desired x-ray spectrum. In some methods, at least one of a pulse form or a pulse amplitude are varied by the at least one of the electron beam generator or the electric field generator to generate the desired x-ray spectrum.

Some methods further include varying at least one of a vertical focal spot positioning and a variable focal spot shape are varied. Some methods include reversing the electric field, as the electron beam passes through a ring electrode of the electric field generator, to decelerate the beam through electrostatic attraction. In some methods, the reversing the electric field comprises bending the electron beam back.

It is to be understood that both the foregoing general description and the following detailed description are exemplary and explanatory and are intended to provide further explanation of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

In the following detailed description, numerous specific details are set forth to provide a full understanding of the present disclosure. It will be apparent, however, to one ordinarily skilled in the art that embodiments of the present disclosure may be practiced without some of the specific details. In other instances, well-known structures and techniques have not been shown in detail so as not to obscure the disclosure. In the referenced drawings, like numbered elements are the same or essentially similar. Reference numbers may have letter suffixes appended to indicate separate instances of a common element while being referred to generically by the same number without a suffix letter.

Figure 1A:
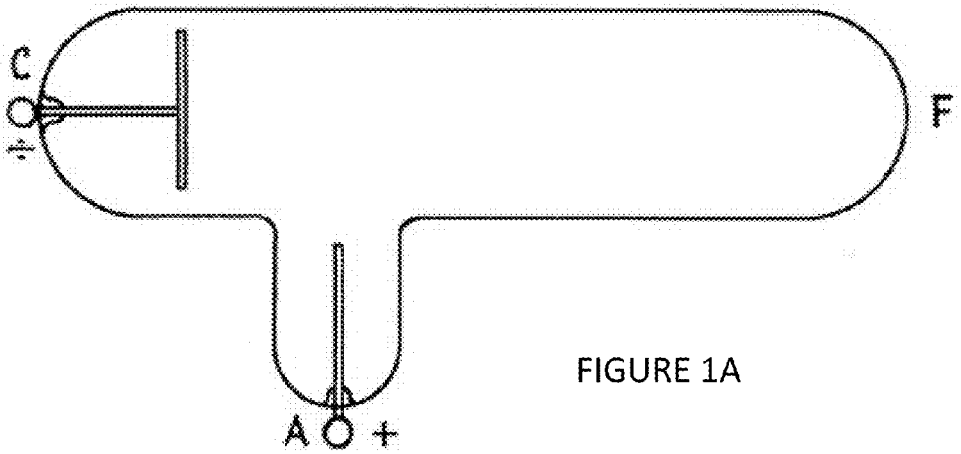
FIG. 1A depicts an example of a Crooke's tube.

In FIG. 1A, the Crooke's tube has a cathode C that is negative in respect to the anode and is the source of electrons generated by ion bombardment. The electrons are accelerated by an electric field applied cathode to anode and that impact the frame at F. Over time the electrons drain to the anode A.

Figure 1B:
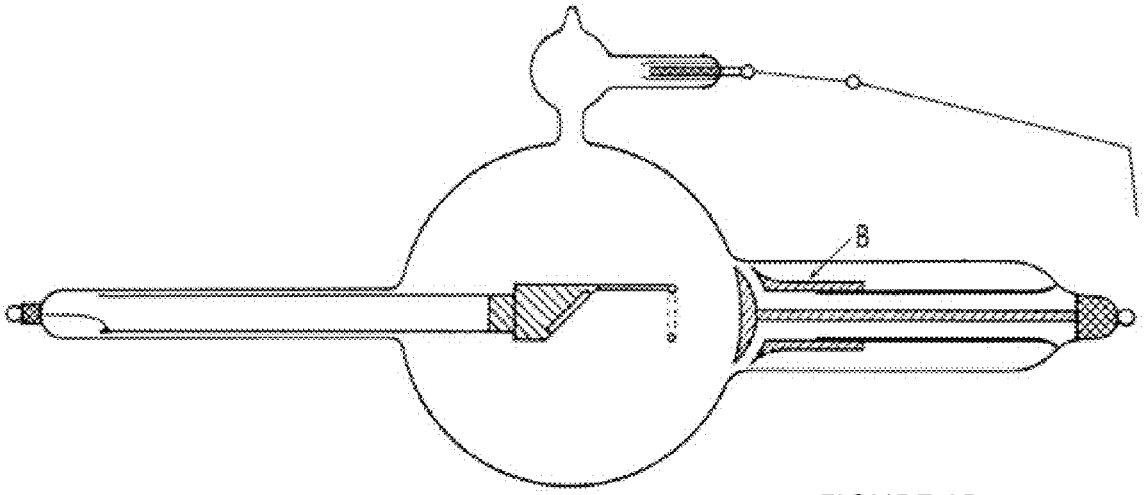
FIG. 1B depicts an example of an ion tube.

In FIG. 1B, an ion tube includes a cathode, which is the electrode to the right; and an anode, which is the electrode to the left. The cathode is electrically negative with respect to the anode. Electrons are generated on the concave surface of the cathode through ion bombardment. The electrons are focused by the anode ring grid and impact on a thin refractory material braze on the copper anode. A gas regulator is attached on the top of the x-ray tube.

Figure 1C:
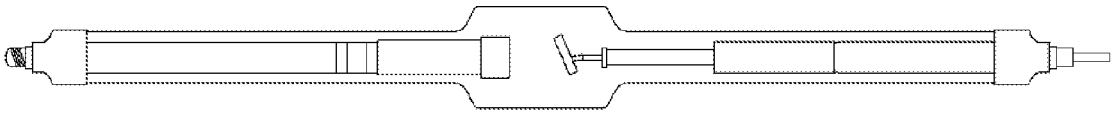
FIG. 1C depicts an example of a Coolidge tube.
Figure 1D:
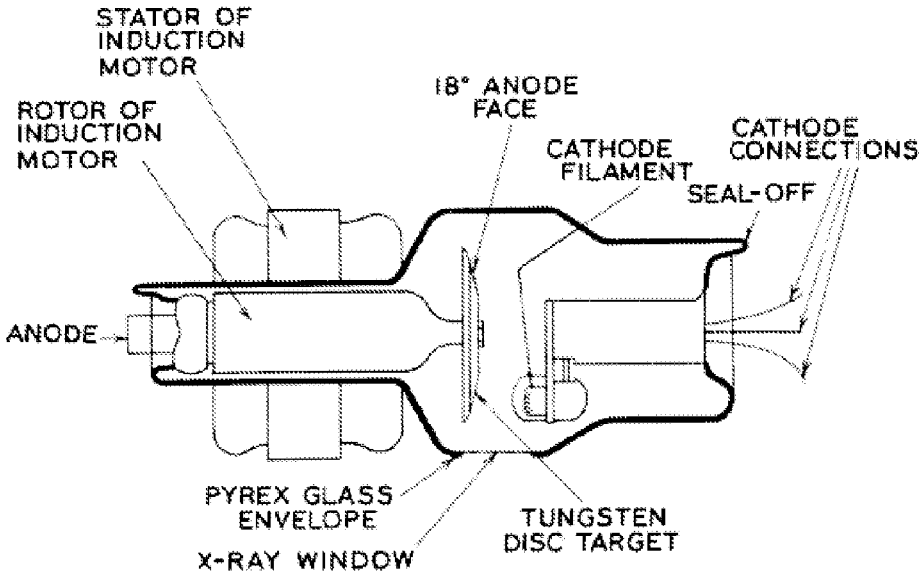
FIG. 1D depicts another example of a Coolidge tube.

In the Coolidge tube of FIG. 1C, the cathode is the electrode on the left. Illustrated is an electrically energized tungsten spiral filament for control of tube current independent of applied voltage. The anode electrode is on the right. Also shown is the solid tungsten target disk attached to a long stem; the glass frame is smaller than those of ion tubes due to the superior insulating properties of the high vacuum. FIG. 1D illustrates a principle of operation, a rotating anode and line focus filament, used in contemporary x-ray tubes and used in high power applications.

In a traditional x-ray tube the high energy electron beam interacts with the target material in one of two different ways. In one type of interaction energy is transferred from the electron to the target material through ionizational collisions. The second type of interactions, radiational collisions, results in the production of radiation. At the energy range of x-ray tubes, typically 30 keV to 250 keV, the ionizational collisions dominate greatly, and as ionizational collisions ultimately lead to heat generation, the majority of energy input into the x-ray tube results in unwanted heat.

Radiational collisions depend upon the fast moving electrons moving past an atomic nucleus close enough to experience an electrostatic force, or in rarer cases ejecting an electron out of an orbital shell. In a typical metallic target, such as tungsten, atoms are arranged in crystallographic structure and are separated by about 3 Angstroms, or 3×10E-10 meters. However, the nuclei of these atoms, which though not hard spherical structures, occupy the center of the atom and can be assumed to have a diameter of 5-10×10E-15 meters. Approximately five orders of magnitude separate the radial distance of the atom and the nucleus. The vast majority of the atomic volume is open space and given the classical electron radius of 2.8×10E-15 meters the chances of an encounter close enough to experience electrostatic deceleration is rare. In addition, the electrostatic force decelerating the electron, inversely proportional to the square power of distance, is dependent on electrons passing a random distance from the atomic nuclei, which in turn produces radiation spectra that is continuous from the peak electron energy down to zero. The low efficiency of current x-ray tubes is a result of the rare and random nature of radiational collisions. The evolution of x-ray tubes from Crookes tubes to ion tubes to Coolidge tubes to the high power, rotating anode sought, at least in part, to address the heat generated as a result of this low efficiency, but the evolution does not change the efficiency of the x-ray tubes.

The deceleration of the electron radiates energy proportional to the square of the force of deceleration. In traditional x-ray tubes, this rate of deceleration is dependent on chance encounter of the electron with the nucleus of an atom. The first principle provided in this present disclosure begins with the observation that there is a unique set of trajectories and momentums for the energetic electron whereby the energy released by the force of deceleration equals the total energy of the electron. The full radiative stop in a single event is rare given the random nature of the paths of the electrons.

The full radiative event results in a photon of the same energy as the incoming electron, which is the maximum photon energy possible for a given accelerating potential. The first principle provided in this present disclosure expands upon this observation by replacing the random nature of the decelerating electric field of the nuclear structure of an atom with a known, externally applied electric field constructed to model, or in some embodiments exactly mimic, the action of the full radiative stop. Each and every electron will be subjected the same decelerating force and therefore all electrons in the electron beam will be produce the same, or nearly the same, radiative output.

The critical electric field strength, that field required to induce a breakdown in a vacuum, is dependent on many factors such as electrode material and electrode gap spacing. The maximum static electric field achievable in a vacuum, known as the critical electric field, is in the range of 10E10 V/m. However, in typical tube design, vacuum gaps separating the cathode from the anode are designed to accommodate electric field strength much less than the critical filed strength, usually on the order of 10E6 Volts/meter. Applied electrical fields that exceed this amount tend over time to lead to high voltage instability and vacuum breakdown that disturbs the operation of the overall system and can lead to x-ray tube failure. Yet, to rapidly decelerate an energetic electron beam in a manner that simulates a full radiative event, an electric field of at least five orders of magnitude beyond this typical limit is required.

The second principle of the systems and methods provided herein is that there is a time dependent element to vacuum breakdown events. Vacuum breakdown is linked to a series of events that often begin with an enhancement of the applied field in the x-ray tube. There are macroscopic field enhancement factors, such as a shape of an electrode, and there are microscopic field enhancements, such as contaminates on the high voltage surfaces or defects in the materials exposed to the high voltage field. Microscopic field enhancements are extremely detrimental to the high voltage stability of the x-ray tube as they locally alter the electric field while not affecting the overall field applied. Electric field enhancements on the order of 10E4 and greater are common before any electrical conditioning of newly fabricated x-ray tubes. And even after conditioning, these field enhancement defects continue to develop in regions of high field during the life of the x-ray tube yielding ongoing concerns of high voltage stability.

Field enhancement defects lead to field emission, which is a quantum mechanical tunneling phenomenon, which in turn leads to Joule heating (from the field emission current) at the site of the field emitter. As the cross sectional dimensions of field emitters are usually in the 10E-6 meters or less, a field emission of nano-Amperes is enough to locally heat the emission area. This heating in turn enhances atom mobility, and as a result of the applied field, the microscopic field emitter tends to grow, sharpen and emit even more. A cascading situation is quickly set up where eventually the joule heating is sufficient to vaporize the field emitter or liberate significant adsorbed gasses to create an ionized path between the cathode and anode. This ionized path electrically shorts the normally high impedance gap and causes a high voltage breakdown to occur.

The vacuum gap is not a static environment but rather an environment where materials migrate, adsorbed gasses move, field emission occurs, and defects that cause field enhancement grow, and breakdown and new defects arise due to damage done to the electrode surface during breakdown. It is an ongoing process that limits the electrical field that can be applied to the x-ray tube.

However, these breakdown events have a time element associated with the establishment of field emitters and the eventual ionization of these emitters leading to breakdown. Typically, the time associated with these events is in the order of tens of nanoseconds. When a high voltage field that exceeds the critical breakdown strength of the vacuum gap is applied and then removed in a time frame less that that required for the establishment of a vacuum breakdown, then stable tube operation results.

Figure 2:
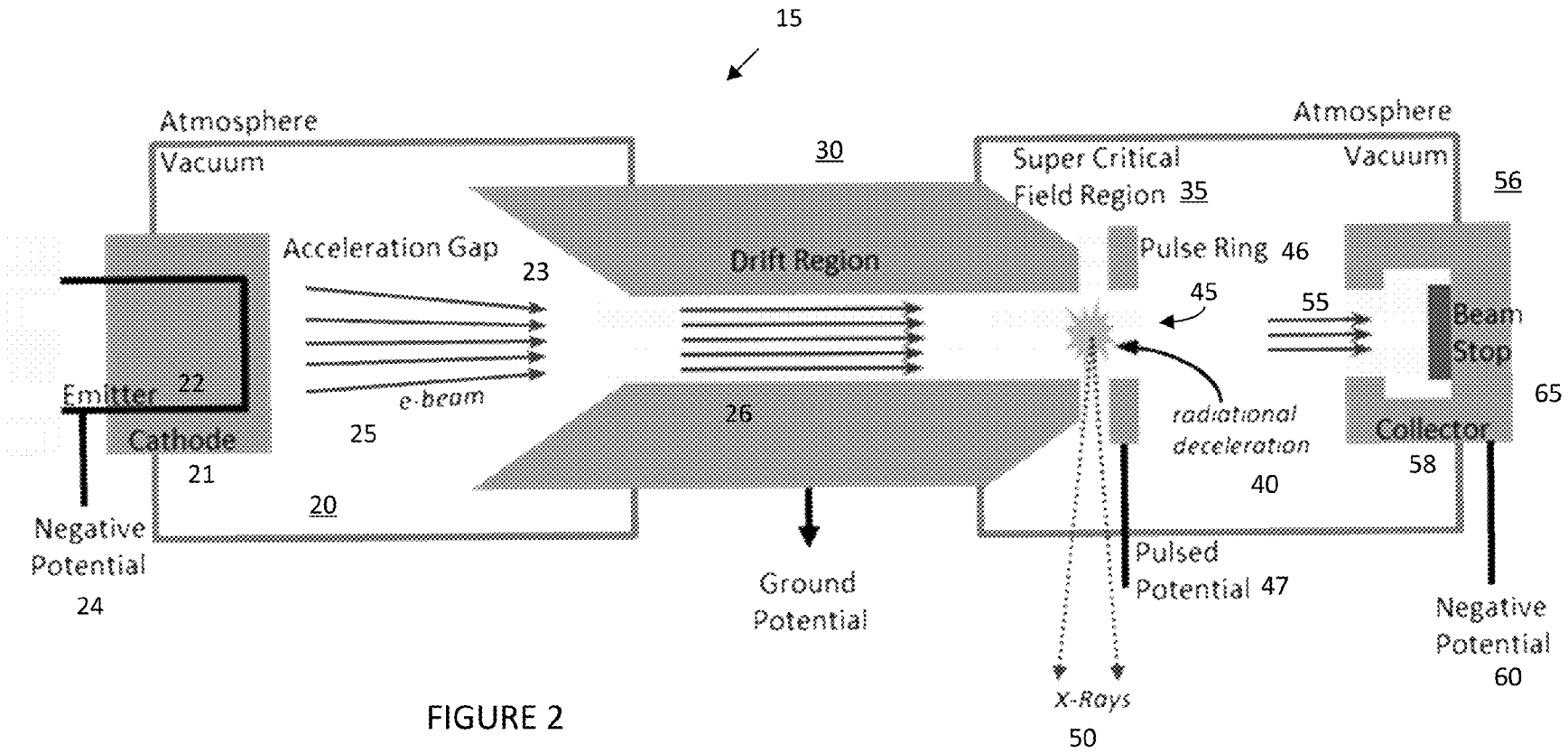
FIG. 2 depicts an x-ray tube according to embodiments of the present disclosure.

The systems and methods herein provide for a new type of x-ray tube where a high energy electron beam, generated and accelerated, is aimed into a vacuum gap region where a super-critical field is applied to cause electron beam deceleration similar to that caused by radiational collision. The super-critical field is then removed prior the establishment of a high voltage breakdown yielding stable tube operation. Additionally, the super critical field is pulsed on and off in quick fashion allowing only enough time for the vacuum arc failure process to reset, thereby giving a near continuous radiation output. As the deceleration is applied to all electrons the efficiency will be very high, and as the deceleration field is known and can be adjusted, the energy output of the x-ray tube can therefore also be set and controlled. FIG. 2 depicts an exemplary system that performs such methods.

The schematic illustration of FIG. 2 details three major regions of an x-ray tube 15 incorporating a super-critical field. The first region 20 on the left accelerates and focuses an electron beam 25 and injects this beam into a field free drift region 30. Exiting the drift region the electron beam 25 enters the super-critical field region 35 where a radiational deceleration force 40 is applied through a pulsed super critical electric field 45. X-rays 50 are generated in all directions, and those illustrated in FIG. 2 exit the x-ray tube along a central ray normal to the tube axis 54. Finally, those electrons 55 that pass through the super critical field region during a pulse-off time period are gradually decelerated with a negative potential 60 near the cathode potential at the collector electrode 65. As these electrons are deposited with very low energy, little or no heat energy is generated.

Figure 3A:
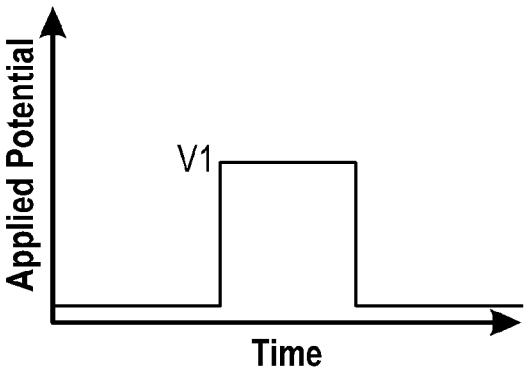
FIGS. 3A-3C illustrate the relationship between applied potentials and the resulting photon energy.
Figure 3A:
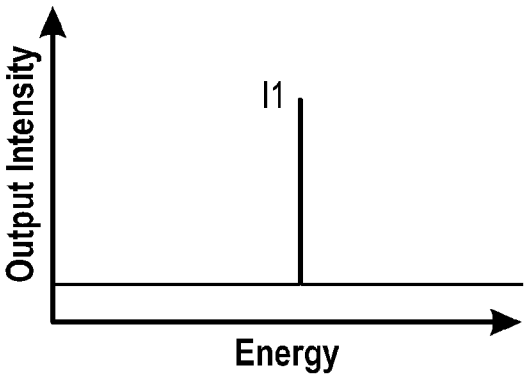
Figure 3B:
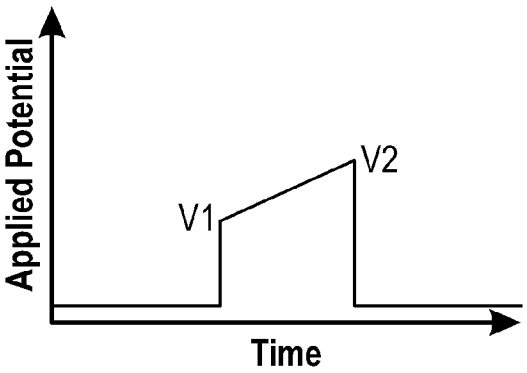
Figure 3B:
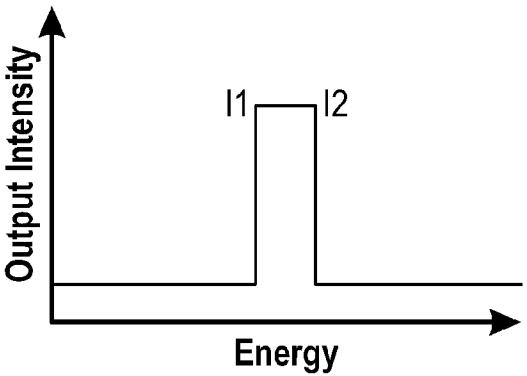
Figure 3C:
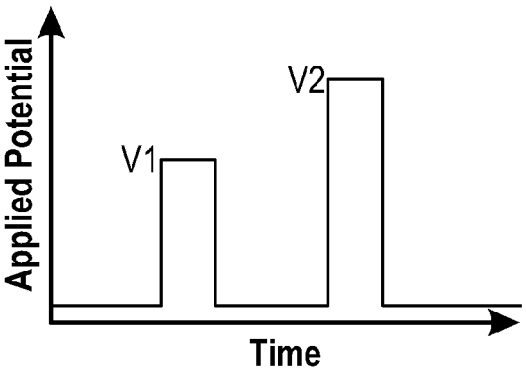
Figure 3C:
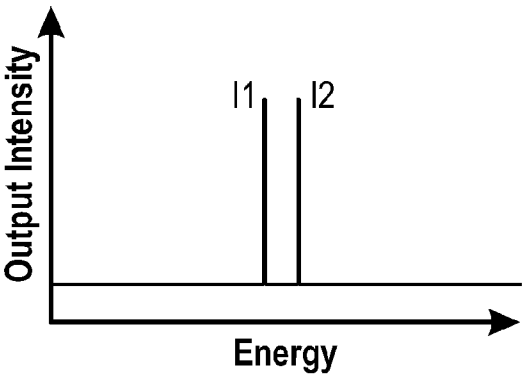

FIGS. 3A-3C depict a series of illustrations that show the relationship between the applied potential to the super-critical region of the x-ray tube and the resulting photon energy spectra. In FIG. 3A, it is noted that a square wave pulse from zero to V1 and then back to zero results in an energy spectra with a discrete energy output. In FIG. 3B, a pulse from zero to V1, then ramping to V2, and returning to zero results in a broader spectra output from I1 to I2. Finally in FIG. 3C, to separate square wave pulses from zero to V1 and back to zero and zero to V2 and back to zero respectively yields a spectra with two sharp lines at I1 and I2. A key element of the super-critical field is that it is configured to provide a uniform deceleration to ensure a narrow x-ray radiation output, and these depicted relationships are examples of the narrow x-ray radiation output that can be achieved through the embodiments described herein.

An x-ray tube that employs a super-critical field for the radiational deceleration of electrons includes three stages: the electron beam acceleration stage, the radiation generation stage, and the electron collector stage.

The electron beam acceleration stage includes a cathode electrode 21 where an electron beam 25 is generated, an acceleration region 23 where the electron beam is shaped and accelerated, and a drift tube 26 which provides a path for the electron beam towards the main decelerating field. Electron beam generation can be done with a thermionic emitter, such as a tungsten filament or any other emitter (e.g., work-function enhanced emitters or cold cathode emitters, such as field emission points and carbon nanotubes). The electron emitter 22 is situated inside a metallic cathode cup which provides stabilization for the emission means and initial electron beam shaping through macroscopic geometry. The emitter 22 is electrically referenced to a negative potential 24 and powers the electron emission such as an electrical current which heats the filament and creates the electron beam through thermionic emission. The cathode cup can be referenced electrically to the emitter ss or it could maintain a slightly more negative potential for main beam shaping and pinching. The acceleration region 23 of the acceleration stage supports the acceleration of the electron beam 25 through a shaped electric field which focuses the electron beam 25 into the drift tube 26. The high voltage gap can be constructed with a gap distance such that stable high voltage operation is maintained at all times. The drift tube serves key roles of delivering the electron beam to the radiation generating stage as well as providing a ground reference and a mechanically supportive structure for the tube device. The acceleration stage is enclosed such that an ultra-high vacuum (e.g., 10E-7 Torr or lower) can be maintained. The enclosure could be constructed of glass with multiple glass-to-metal seals, or it could be a combination of ceramics and metal or it could be constructed of other similar materials. The enclosure preferably supports the application of the electrical potential at the cathode electrode.

The radiation generation stage provides a super critical electric field 45 such that the electrons are decelerated with a force to cause radiation. The main element in the radiation generation stage is a shaped ring electrode 46 that provides support to a pulsed retarding potential 47 causing a deceleration field. The electric field created by this tube 15 can be calculated from the example of the full radiative emission in the traditional x-ray tube, as the field required to stop all the electrons in the super-critical electric field 45 will be the same. The field can be determined from Maxwell's equation of electrodynamics which describes radiation from an electron decelerating in the nuclear electric field. Using basic assumptions the lower and upper range of the electric field is calculated to be 10E11 to 10E13 V/m. These fields compare similarly to those generated by fast pulse, high field laser x-ray generation where electric field of 10E12V/m are generated through the ponderomotive force. Additionally, the required electric field can be confirmed through comparison to of the electric field calculated with Coulombs Law knowing the dimensions of the atomic and total charge. Again, the calculated field strength required is on the order of 10E13V/m. The electrode is preferably fashioned in the shape of a ring to facilitate the electrons that are not decelerated during the pulse off time to pass through the ring electrode and into the electron collector stage. The ring 46 is placed in close proximity to the exit of the drift tube to aid in establishing a well-defined, high intensity electric filed. The exact geometry of the exit port of the drift tube and the ring electrode are preferably designed to define the position in the x-ray tube that the x-rays will be produced and, therefore, where the virtual focal spot of the x-ray tube will be. The localized field where the super-critical field 45 will be applied to the electron beam is defined as the 'virtual anode' 48 and will have the dimensions up to a few cubic microns. In addition, variation in focusing of the electron beam in the acceleration stage leads to variations in the dimensional cross-section of the beam passing through the super-critical field region which leads to the ability to change the shape and size of the virtual focal spot. Additionally, variations imposed in the externally applied super-critical electric field 45 will also lead to variations in the x-ray output. Variations in the electron beam and applied field can shape and conform the output x-radiation field, which can have a positive impact on the imaging of a diagnostic device. It should also be noted that by observation, a locally uniform magnetic field could be impressed to create a radial Lorentz force, which would also accomplish electron deceleration. A magnetic field required of at least 10T would be sufficient to accomplish radiative deceleration.

The electron collection stage 56 is the final stage of the device. As the super-critical electric field 45 is pulsed on and off, and the off time must remain long enough to return the vacuum gap to the initial dielectric integrity, some electrons will exit the drift tube 26 and pass directly through the ring electrode 46 as it is electrically ground referenced when in the off condition. These electrons are then subject to a very gradual deceleration to an energy level of just below that given in the accelerating stage. These electrons are then collected at the collector 58 which is made of a metal with good thermal conductivity. A thin piece of refractory metal such as tungsten can be incorporated into the collector to ensure proper heat management at the surface of the collector. Additionally, as in the construction of the electron beam acceleration stage, this entire region is maintained in an ultra-high vacuum. The walls of the x-ray tube separating the atmospheric pressure from the vacuum of the tube can be constructed from glass and metal seals, from metals and ceramics or from any other material that maintains structural integrity and electrical insulations between the electrodes. It may also be beneficial to include an x-ray port window along the central x-axis of the x-ray beam for mechanical identification of the x-ray beam central ray and controlling any filtration that may occur from the frame material.

In some embodiments, the radiation generation stage is designed where the ring electrode 46 is configured to electrostatically attract the electron beam with a field strong enough to cause the electron beam as it passes through the ring electrode to bend enough to completely radiate the majority, if not all, the kinetic energy of the beam. Though the field, in these embodiments, is now attractive at the ring electrode, it still requires a field strength many orders of magnitude above what is normally considered the critical field strength of a vacuum gap. In some embodiments, a system can implement both methods of decelerating an electron, and these methods are alternated, thereby alternating the direction of the electric field in the super-critical field, and in effect forcing a quicker recovery for each pulse that is applied. First, decelerating the beam with a repulsing force. Then, reversing the field so those electrons then passing through the ring are bent back strongly enough to radiate all energy, then repeating the process. And each field reversal has the benefit of recovering the vacuum gap from the previous half-cycle. The result is a self-healing super-critical field through constant field reversal, always generating x-rays in the meantime.

Figure 4:
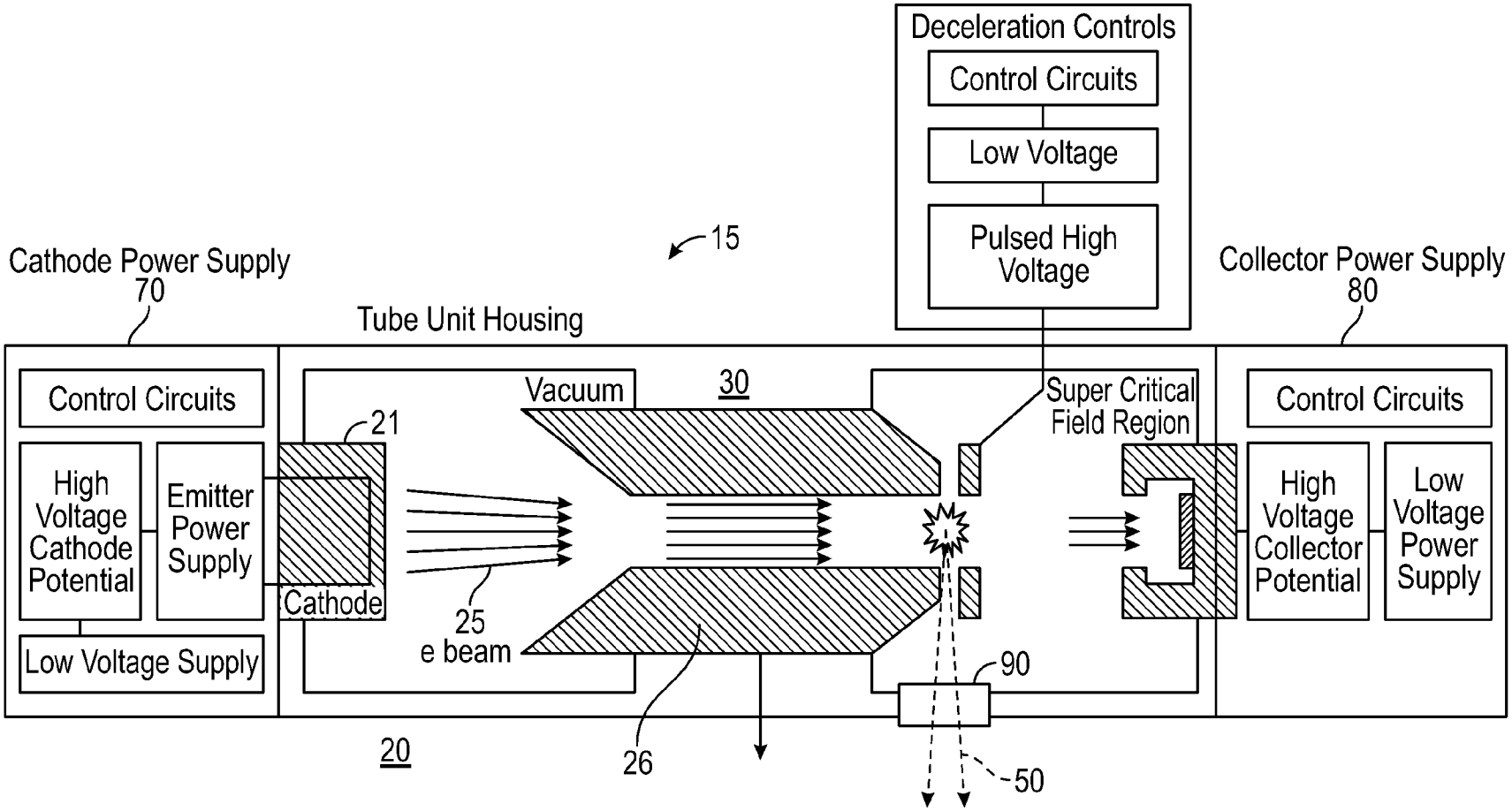
FIG. 4 depicts an x-ray tube according to embodiments of the present disclosure.

Multiple configurations can be envisioned for the incorporation of the x-ray tube 15 into an x-ray generating system. FIG. 4 illustrates a schematic view of some such embodiments. As the efficiency of the device is high, the size of the power supplies can be compact when compared to a standard x-ray tube power supply. The power supplies 70, 80 shown are of a high frequency, high impedance design and preferably constructed with all solid dielectrics. Such power supplies could attach mechanically and electrically directly to the x-ray tube 15 thereby eliminating the need for any high voltage cables, though separate supplies and high voltage connection cables could be used in some embodiments.

In the embodiments shown in FIG. 4, there is a separate power supply for the cathode 70 and the collector 80; however, as the potentials on the two are nearly identical, a configuration could be envisioned where only one supply is electrically connected to each of the electrodes. The embodiments shown also incorporate a tube housing 15 for the inclusion of a mechanical x-ray port window 90, mechanical rigidity, electrical grounding and easy system mounting. Due to the high frequency of the pulses to the ring electrode, it may be desirable to mount the pulsed power supply either on the tube housing or actually inside the working x-ray tube. Elimination of any stray capacitance and inductance is beneficial in achieving desired waveforms.

Figure 5:
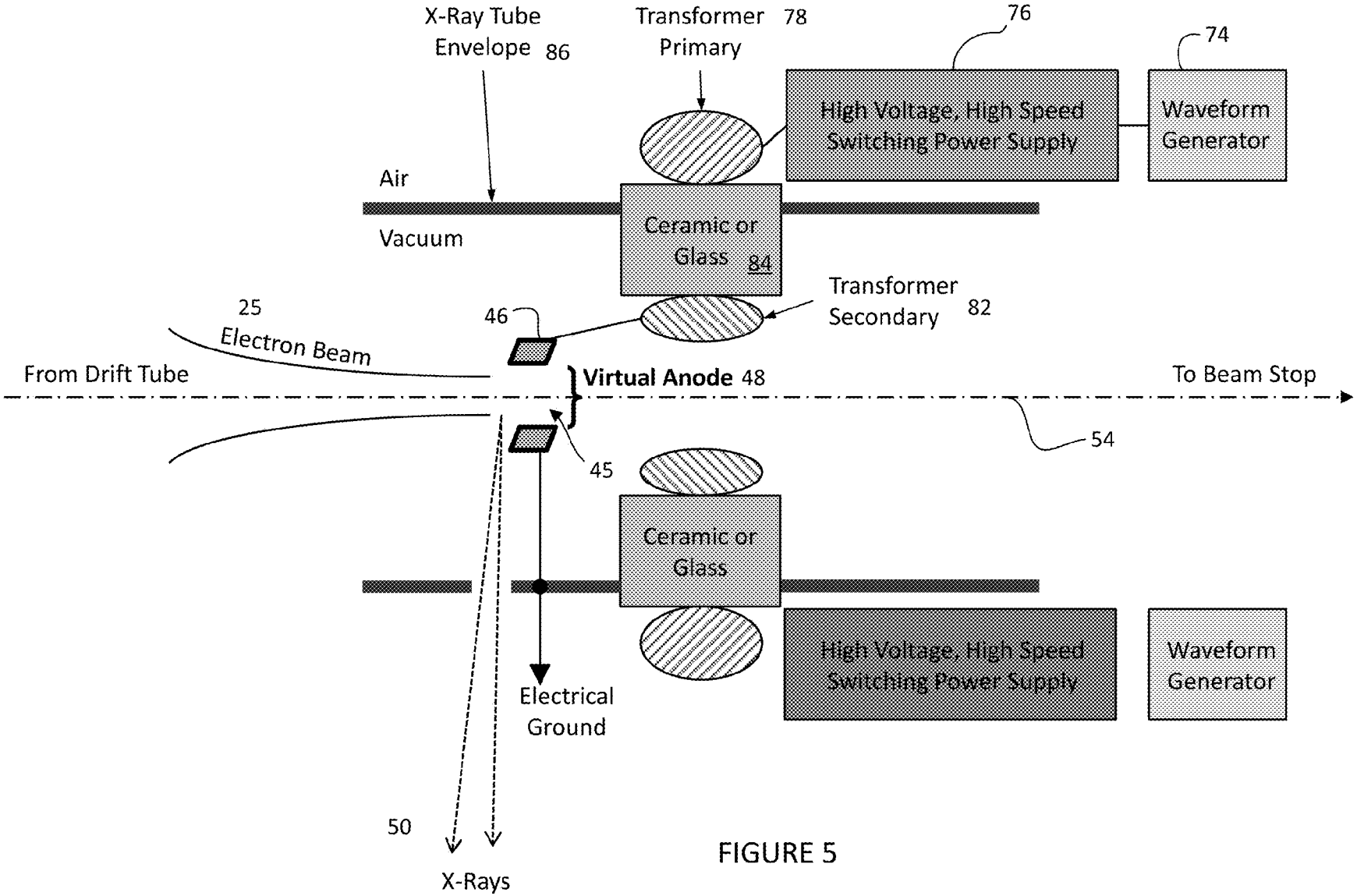
FIG. 5 depicts an x-ray tube according to embodiments of the present disclosure.

FIG. 5 illustrates such an embodiment where there would be a low voltage, e.g., 0V to 5V, waveform generator that generates the desired pulse pattern. The output of this waveform generator 74 would input into a solid state high voltage pulse power supply base 76 on IGBT (Insulated-Gate Bipolar Transistor), or similar, solid state switches. Typical high speed switches based on staged IGBT assemblies output 0V to 10 kV pulses of a duration of nanoseconds or less. Due to the high efficiency of the x-ray conversion the load on the power supply will be minimized, thereby ensuring fast rise times and consistent operation. The output of high voltage, high switching speed power supply leads to the primary winding of a step-up transformer 78 where the secondary 82 is directly connected to the electrode 46 providing the super critical electrical field 45 across the virtual anode 48. This step up transformer is wound in such a method to produce a voltage increase of 10 times to 1000 times, the number of turns determined by the electric field required across the virtual anode. Additionally, the insulation between the primary and secondary windings could be constructed of a solid dielectric 84 such as ceramic or glass and incorporated into the main vacuum envelop of the x-ray tube. In this way the primary winding would be exterior to the vacuum while the secondary winding, providing the pulsed electric field would be in the vacuum environment directly adjacent to the pulsing electrode. In this way excessive reactance can be eliminated. Furthermore, to maintain a compact size of the overall device, these waveform generator and high voltage high speed switching power supply are built around the circumference of the x-ray tube house 86, adjacent to the primary transformer winding.

The previous description is provided to enable any person skilled in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "a set" and "some" refer to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed:

1. A device for generating x-ray energy, comprising:

an electric field generator that generates an electric field having an energy of greater than about 10E7 V/m without electrical breakdown of vacuum gaps; and an electron beam generator that generates an electron beam and directs the beam toward the electric field.

2. The device of claim 1, wherein the electric field generator generates the electric field without electrical breakdown of vacuum gaps by pulsing on and off before processes leading to vacuum breakdown can be established.

3. The device of claim 2, wherein the generator pulses on and off to generate the electric field for about 100 picoseconds to about 90 nanoseconds.

4. The device of claim 1, wherein the electric field is configured to decelerate electrons in the electron beam sufficiently to generate x-ray energy.

5. The device of claim 1, wherein the electron beam generator generates the electron beam by thermionic emission.

6. The device of claim 1, wherein the electron beam generator generates the electron beam by cold emission.

7. The device of claim 1, wherein the electron beam generator generates the electron beam by enhanced work-function emission.

8. The device of claim 1, further comprising a cathode having a potential and an electron collector configured to be at or near the cathode potential, such that electrons not decelerated through the electric field are collected.

9. The device of claim 1, further comprising a decelerating ring electrode at which the electric field is generated.

10. The device of claim 9, further comprising an x-ray tube frame, and a power supply for the decelerating ring electrode is attached directly to the frame.

11. The device of claim 9, further comprising an x-ray tube frame, and a power supply for the decelerating ring electrode is positioned within the frame.

12. The device of claim 1, wherein the electron beam generator and the electric field generator are configured to produce various pulse forms and amplitudes to generate a desired x-ray spectrum.

13. The device of claim 1, wherein the device is configured to have a variable vertical focal spot positioning and a variable focal spot shape.

14. The device of claim 1, wherein the electric field generator is configured to reverse the electric field to first decelerate the electron beam, and thereafter, as the beam passes through a ring electrode, decelerate the beam through electrostatic attraction and bending the electron beam back.

15. An x-ray tube, comprising:

an electron beam acceleration region that generates an electron beam and accelerates electrons in the beam; and a radiation generation region that (i) receives the electron beam and (ii) generates an electric field having an energy of greater than about 10E7 V/m without electrical breakdown of vacuum gaps;

wherein the electric field is configured to decelerate electrons in the electron beam sufficiently to generate x-ray energy.

16. The x-ray tube of claim 15, further comprising a cathode having a potential and an electron collector configured to be at or near the cathode potential, such that electrons not decelerated through the electric field are collected.

17. The x-ray tube of claim 15, wherein the electron beam acceleration region generates the electron beam by thermionic emission.

18. The x-ray tube of claim 15, wherein the electron beam acceleration region generates the electron beam by cold emission.

19. The x-ray tube of claim 15, wherein the electron beam acceleration region generates the electron beam by enhanced work-function emission.

20. The x-ray tube of claim 15, wherein the electron beam is accelerated by the acceleration region across a vacuum gap.

21. The x-ray tube of claim 15, wherein the electron beam acceleration region comprises a drift tube into which the electron beam is directed prior to the electron beam being received by the radiation generation region.

22. The x-ray tube of claim 15, further comprising an electrode for the application of a radiational decelerating field.

23. A method for generating x-ray energy, comprising:

generating, with an electric field generator, an electric field having an energy of greater than about 10E7 V/m without electrical breakdown of vacuum gaps; and directing an electron beam, from an electron beam generator, toward the electric field.

24. The method of claim 23, further comprising pulsing generation of the electric field on and off, such that processes leading to vacuum breakdown are not established while the electric field is generated.

25. The method of claim 24, wherein the time the electric field is pulsed on is from about 10 to about 90 nanoseconds.

26. The method of claim 23, wherein the electric field decelerates electrons in the electron beam sufficiently to generate x-ray energy.

27. The method of claim 23, wherein the electron beam generator generates the electron beam by thermionic emission.

28. The method of claim 23, wherein the electron beam generator generates the electron beam by cold emission.

29. The method of claim 23, wherein the electron beam generator generates the electron beam by enhanced work-function emission.

30. The method of claim 23, further comprising collecting electrons not decelerated through the electric field with an electron collector configured to be at or near a potential of a cathode of the electron beam generator.

31. The method of claim 23, wherein the electric field is generated at a decelerating annular electrode.

32. The method of claim 23, further comprising varying at least one of the electron beam generator or the electric field generator to generate a desired x-ray spectrum.

33. The method of claim 32, wherein at least one of a pulse form or a pulse amplitude are varied by the at least one of the electron beam generator or the electric field generator to generate the desired x-ray spectrum.

34. The method of claim 23, further comprising varying at least one of a vertical focal spot positioning and a variable focal spot shape are varied.

35. The method of claim 23, further comprising reversing the electric field, as the electron beam passes through a ring electrode of the electric field generator, to decelerate the beam through electrostatic attraction.

36. The method of claim 35, wherein the reversing the electric field comprises bending the electron beam back.

* * * * *